US008166724B2

(12) United States Patent
Lemyre

(10) Patent No.: US 8,166,724 B2
(45) Date of Patent: May 1, 2012

(54) TOP-CHORD BEARING WOODEN JOIST AND METHOD

(75) Inventor: André Lemyre, Trois-Rivières (CA)

(73) Assignee: Solive Ajouree 2000 Inc., Trois-Rivieres, Quebec (CA)

( * ) Notice: Subject to any disclaimer, the term of this patent is extended or adjusted under 35 U.S.C. 154(b) by 306 days.

(21) Appl. No.: 12/388,031

(22) Filed: Feb. 18, 2009

(65) Prior Publication Data

US 2010/0205892 A1 Aug. 19, 2010

(51) Int. Cl.
*E04C 3/02* (2006.01)
*E04C 3/30* (2006.01)
*E04H 12/00* (2006.01)

(52) U.S. Cl. ..... 52/696; 52/690; 52/693; 52/837

(58) Field of Classification Search ..... 52/289, 52/636, 690, 692–695, 696, 836, 837, 841
See application file for complete search history.

(56) References Cited

U.S. PATENT DOCUMENTS

| | | | | | |
|---|---|---|---|---|---|
| 3,416,283 | A * | 12/1968 | Sanford | 52/693 |
| 3,531,904 | A * | 10/1970 | Sanford | 52/696 |
| 3,867,803 | A * | 2/1975 | Platt | 52/693 |
| 3,961,455 | A | 6/1976 | Peters | |
| 4,630,424 | A * | 12/1986 | Eberle et al. | 52/693 |
| 4,641,480 | A * | 2/1987 | Mort | 52/693 |
| 5,560,177 | A | 10/1996 | Brightwell | |
| 5,592,800 | A * | 1/1997 | Koo et al. | 52/692 |
| 5,761,872 | A * | 6/1998 | Sanford et al. | 52/694 |
| 5,867,962 | A * | 2/1999 | Scott et al. | 52/696 |
| 5,867,963 | A * | 2/1999 | Hershey | 52/650.2 |
| 6,584,741 | B1 * | 7/2003 | Hatzinikolas | 52/289 |
| 6,651,306 | B1 | 11/2003 | LePoire et al. | |
| 7,240,463 | B2 | 7/2007 | Masterson et al. | |
| 7,356,974 | B2 * | 4/2008 | Tadich | 52/693 |
| 2007/0256389 | A1 | 11/2007 | Davis | |
| 2008/0250747 | A1 * | 10/2008 | Johnson et al. | 52/693 |

FOREIGN PATENT DOCUMENTS

CA 2195616 1/1997

OTHER PUBLICATIONS

International Search Report, PCT/CA2010/000196, Mar. 11, 2010.

* cited by examiner

*Primary Examiner* — Brian Glessner
*Assistant Examiner* — Adriana Figueroa
(74) *Attorney, Agent, or Firm* — Norton Rose Canada LLP

(57) ABSTRACT

A wooden joist comprises wooden top chord and bottom chords. Wooden boards are adhesively connected to the chords to form an I-joist section along a portion of the wooden joist. Wooden webs may be adhesively connected to the chords to form an open-joist section along another portion of the wooden joist. A bearing extension is defined by the wooden top chord extending beyond an end of the wooden joist Metal webs are in alignment on opposed sides of the wooden joist. Each metal web comprises a top connector end fixed to the bearing extension, a bottom connector end fixed to the bottom chord, and a structural arm between the connector ends. The metal webs are solely provided in an end region along the wooden joist, whereby the wooden joist is adapted to be in a top-chord bearing relation with a beam.

19 Claims, 10 Drawing Sheets

TOP-CHORD BEARING WOODEN JOIST AND METHOD

FIELD OF THE APPLICATION

The present application relates to wooden joists and, more particularly, to a wooden joist used in a top-chord bearing configuration.

BACKGROUND OF THE ART

Wooden joists are horizontal supporting members that run from wall to wall, wall to beam, or beam to beam to support a ceiling, roof or floor. Wooden joists have a pair of horizontal chords, interrelated by a board in an I-joist configuration, or by V-shaped webs, in an open-joist or truss configuration.

When wooden joists are transversely connected to beams, metal hangers are used to interrelate the joists to the beams. Hangers are brackets that are secured to the beam, and that define a U-shaped so as to support an end of a joist. Hangers are costly items, and require a non-negligible amount of skilled manpower to use.

Some wooden joists are used in a top-chord bearing configuration. In this configuration, the top chord has an extension projecting beyond the bottom chord at an end of the joist. The extension is seated on top of a beam, when the joist is transversely positioned on a beam. As all-wooden joists typically use an adhesive between the chords and the wooden webs/board, all-wooden joists are not used in a top-chord bearing configuration. The top-chord bearing configuration is used with open joists in which the webs are metal, or in open joists in which metal square plates interface the wooden webs to the chords. Both these open joists are relatively expensive as they use numerous metal components.

SUMMARY OF THE APPLICATION

It is therefore an aim of the present application to provide a novel wooden joist for use in a top-chord bearing configuration.

It is a further aim of the present application to a method for adapting a wooden joist to a top-chord bearing configuration.

Therefore, in accordance with the present application, there is provided a wooden joist comprising: a wooden top chord; a wooden bottom chord; wooden boards adhesively connected to the wooden top chord and to the wooden bottom chord to form an I-joist section along a portion of the wooden joist; wooden webs adhesively connected to the wooden top chord and to the wooden bottom chord to form an open-joist section along another portion of the wooden joist; a bearing extension defined by the wooden top chord extending beyond any one of the wooden boards and the wooden webs at an end of the wooden joist; at least a pair of metal webs in alignment on opposed sides of the wooden joist, each metal web comprising a top connector end fixed to the bearing extension, a bottom connector end fixed to the bottom chord, and a structural arm between the connector ends, the metal webs being solely provided in an end region along the wooden joist; whereby the wooden joist is adapted to be in a top-chord bearing relation with a beam by the bearing extension and the top connector ends being on top of the beam.

Further in accordance with the present application, there is provided a method for adapting a wooden joist to a top-chord bearing configuration, comprising: providing a joist having a wooden top chord and a wooden bottom chord adhesively connected to wooden boards to form a joist having at least an I-joist portion; cutting an end of the I-joist section as a function of a required length of the wooden joist in such a way that a bearing extension is defined by the top chord extending beyond the wooden boards at an end of the I-joist; securing metal webs on opposed sides of the wooden joist such that the metal webs are connected to the bearing extension; whereby the joist may be used in a top-chord bearing relation with a beam.

Still further in accordance with the present application, there is provided a wooden joist comprising: a wooden bottom chord; wooden boards adhesively connected to the wooden bottom chord so as to project upwardly therefrom; a wooden top chord adhesively connected to a top edge of the wooden boards to form an I-joist section with the wooden bottom chord and the wooden boards, the wooden top chord extending beyond the wooden boards at an end of the wooden joist to form a bearing extension; and at least a pair of metal webs in alignment on opposed sides of the I-joist, each metal web comprising a top connector end fixed to the bearing extension, a bottom connector end fixed to the bottom chord, and a structural arm between the connector ends, the metal webs being solely provided in an end region along the I-joist; whereby the wooden joist is adapted to be in a top-chord bearing relation with a beam by the bearing extension and the connector ends being on top of the beam.

DESCRIPTION OF THE PREFERRED EMBODIMENTS

Figure 1:
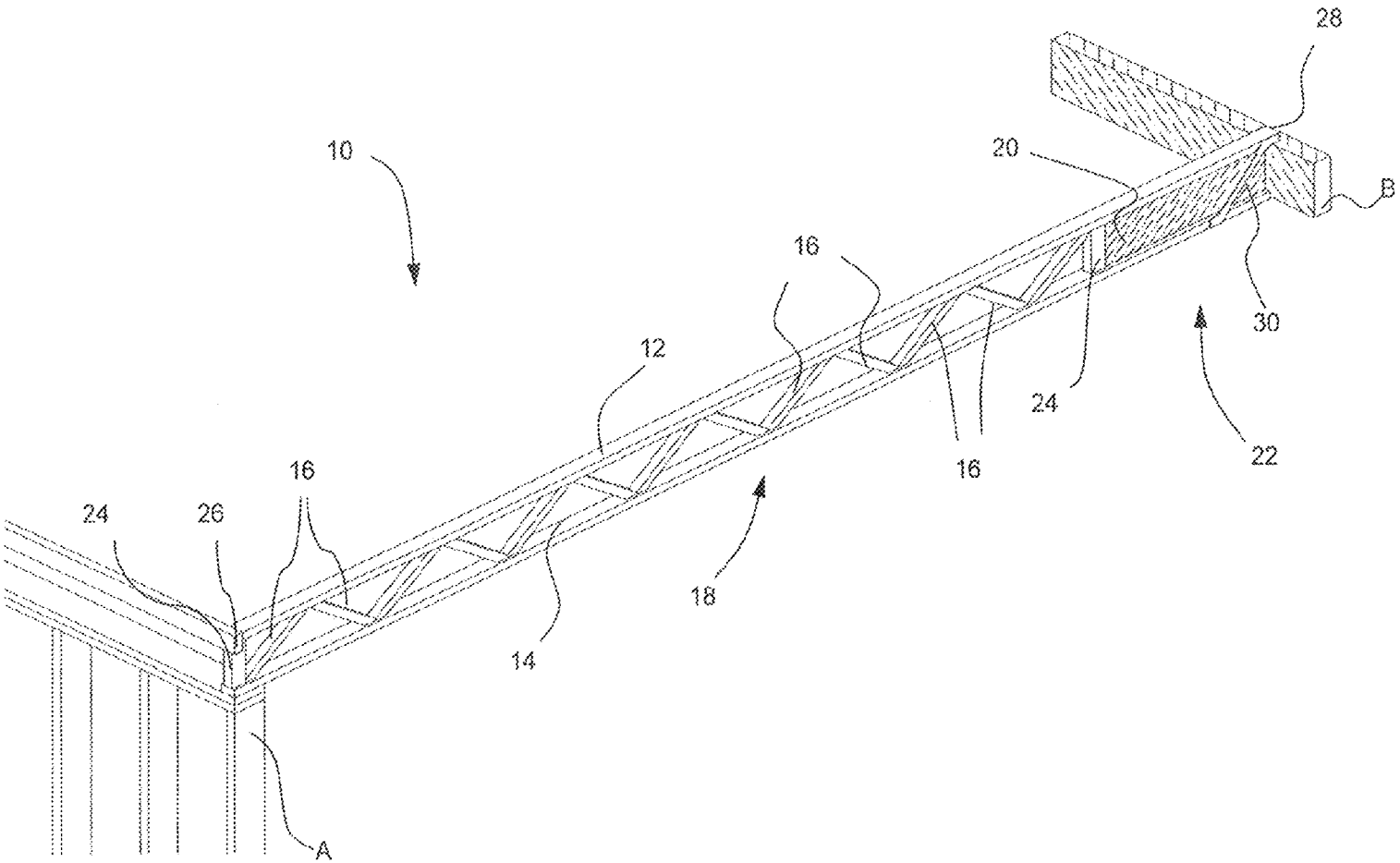
FIG. 1 is a perspective view of a wooden joist in accordance with an embodiment, in a top-chord bearing relation with a beam, on an I-joist section.

Referring to the drawings and more particularly to FIG. 1, a wooden joist in accordance with an embodiment of the present disclosure is generally shown at 10. The wooden joist 10 has a top chord 12 and a bottom chord 14. The top chord 12 and the bottom chord 14 are elongated lumber pieces, interconnected in a parallel relation by wooden webs 16 in an open-joist section 18, and a board 20 in an I-joist section 22.

In the open-joist section 18, the wooden webs 16 form a series of Vs, and are connected to the chords 12 and 14 using adhesives, as well as complementary joint portions (e.g., scarf joints) between the webs 16 and the chords 12 and 14. The section 18 is said to be open, as the gaps between the wooden webs 16 can be used as a passage for pipes, ventilation ducts, wires and the like, in the ceiling or below the floor.

In the I-joist section 22, the board 20 interconnects the chords 12 and 14. The board/boards 20 may be received in channels defined in the chords 12 and 14, with an adhesive used to mechanically connect the board/boards 20 to the chords 12 and 14. Moreover, complementary joint portions, such as scarf joints or the like, may be used to increase the contact area between the chords 12 and 14 and the board 20. The board 20 may be made of different types of wood panels, such as oriented strand board (i.e., OSB), plywood, or the like.

Wooden columns 24 are also provided between the chords 12 and 14. One wooden column 24 is at the junction between the wooden webs 16 and the board 20. Another wooden column 24 is at an end of the wooden joist 10, on the side of the open joist.

Figure 2:
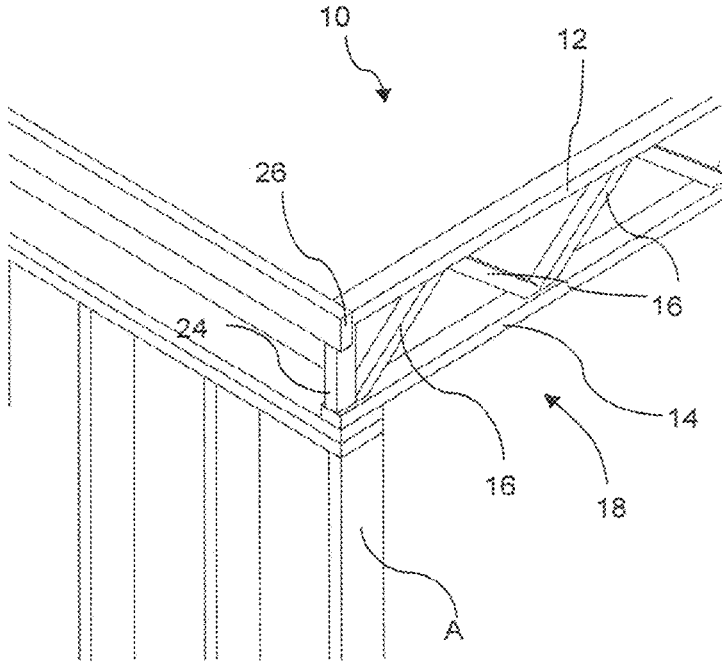
FIG. 2 is an enlarged perspective view of the wooden joist of FIG. 1, with an end in a bottom-chord bearing configuration.
Figure 4:
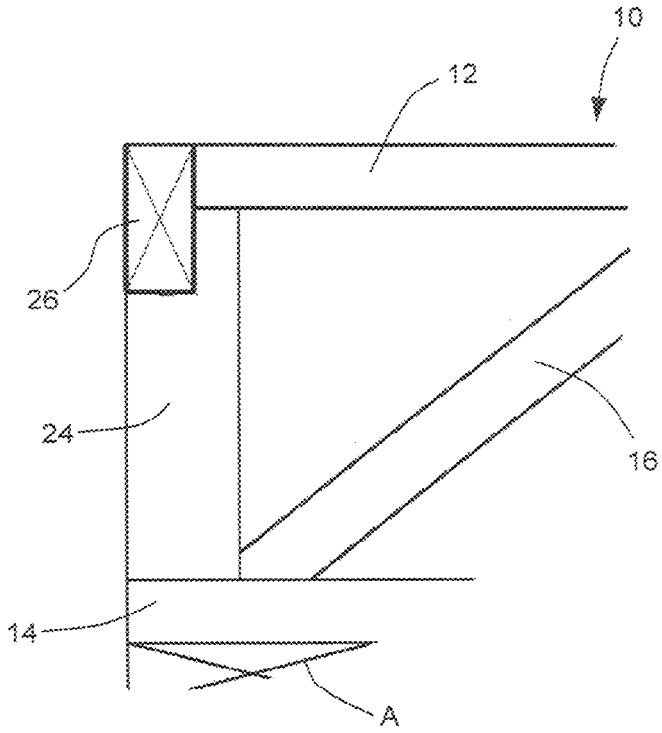
FIG. 4 is an enlarged elevation view of the end of the wooden joist of FIG. 2.

Referring concurrently to FIGS. 2 and 4, a ribbon 26 (aka, a 2×4 ribbon or a 2×4 band) is optionally provided at an end of the wooden joist 10, in a clearance in the top chord 12 and wooden column 24. The ribbon 26 is used for the lateral support of the wooden joist 10, when supported in a bottom-chord bearing configuration, on a structure A.

Figure 3:
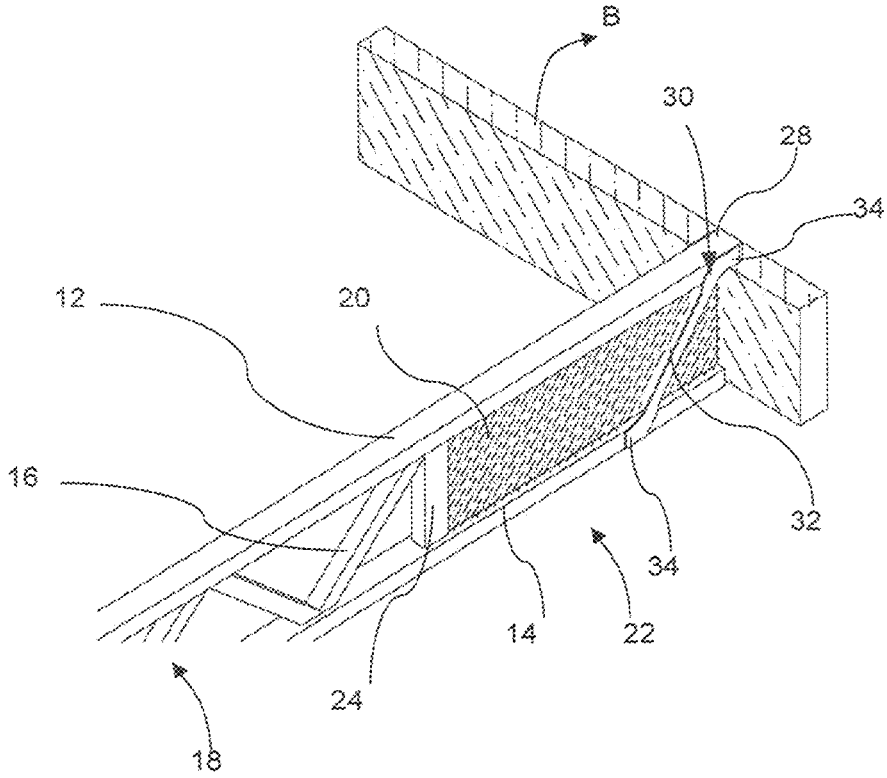
FIG. 3 is an enlarged perspective view of the wooden joist of FIG. 1, with an end in a top-chord bearing relation with a beam.
Figure 5:
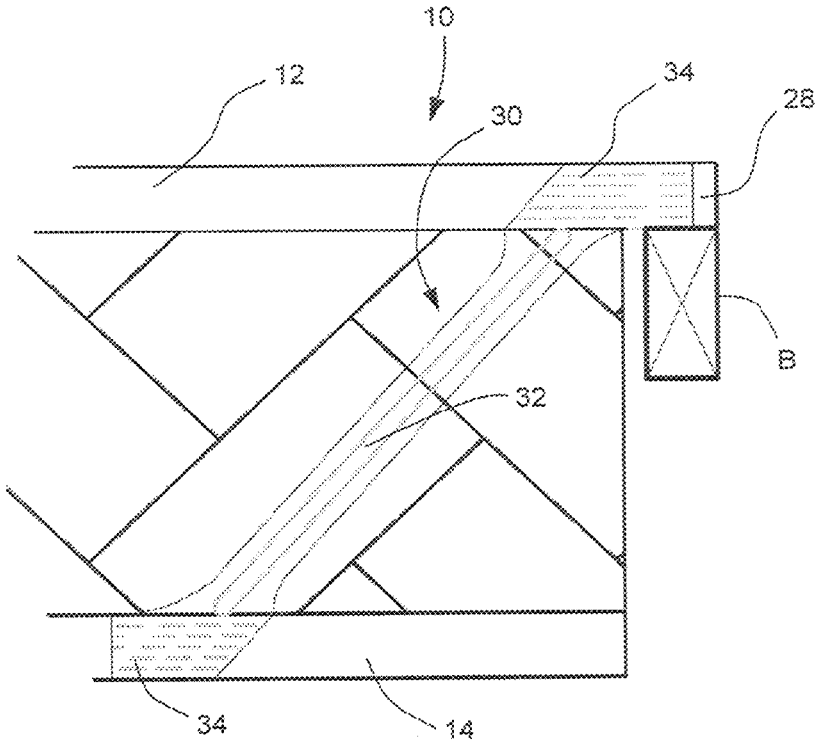
FIG. 5 is an enlarged elevation view of the end of the wooden joist of FIG. 3.

Referring concurrently to FIGS. 1, 3 and 5, the top chord 12 is shown projecting beyond the end of the bottom chord 14 and the end of the board 20. The projection is referred to as bearing extension 28. The bearing extension 28 is seated on an upper surface of a beam B, in a top-chord bearing relation between the wooden joist 10 and the beam B. However, in order to respect the structural integrity of the wooden joist 10, metal webs 30 are added to the wooden joist 10, in the vicinity of the bearing extension 28.

The metal webs 30 each have an arm 32 at the ends of which are connector ends 34. The connectors ends 34 have a plurality of teeth, whereby the connector ends 34 pressed on the lateral surfaces of the chords 12 and 14 are firmly secured thereto. When the metal webs 30 are secured to the wooden joist 10 as illustrated in FIGS. 1, 3 and 5, the arm 32 is in an oblique relation with respect to the chords 12 and 14. The metal webs 30 come in pairs, with a web 30 on each side of the wooden joist 10, whereby only one of the pair of webs 30 is shown in FIGS. 1, 3 and 5.

Accordingly, the metal webs 30 reinforce the wooden joists 10. The metal webs 30 are connected to the wooden joist 10 such that the upper connector ends 34 are on the bearing extension 28. By having the upper connection ends 34 on the bearing extension, a part of the load on the bottom chord 14 is supported by the beam B through the metal web 30.

Figure 6:
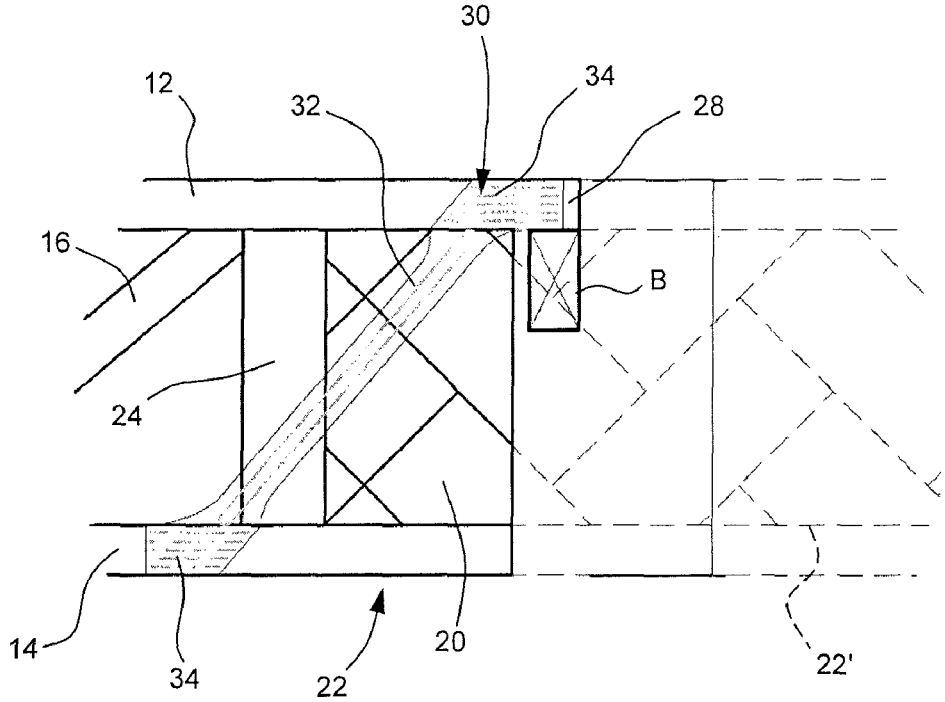
FIG. 6 is an enlarged elevation view of an end of the wooden joist of FIG. 1, with a removed I-joist section.

The I-joist section 22 of the wooden joist 10 is provided to adjust the overall length of the wooden joist 10. The I-joist section 22 may be reduced in length, by removing an end thereof. Referring to FIG. 6, a removed portion of the I-joist section 22 is illustrated at 22'. The removed portion 22' is typically sawn off, forming a cut that is perpendicular to the longitudinal axes of the top chord 12 and bottom chord 14. However, in order to use the wooden joist 10 in a top-chord bearing arrangement, a bearing extension 28 is kept when cutting off an end of the I-joist section 22.

The removal of an end of the I-joist section 22 is preferably performed in plant, according to the length required by a customer. Once a portion has been removed, the metal webs 30 are pressed onto the wooden joist 10. As is shown in FIG. 6, the connector end 34 on the top chord 12 is on the bearing extension 28.

Figure 7:
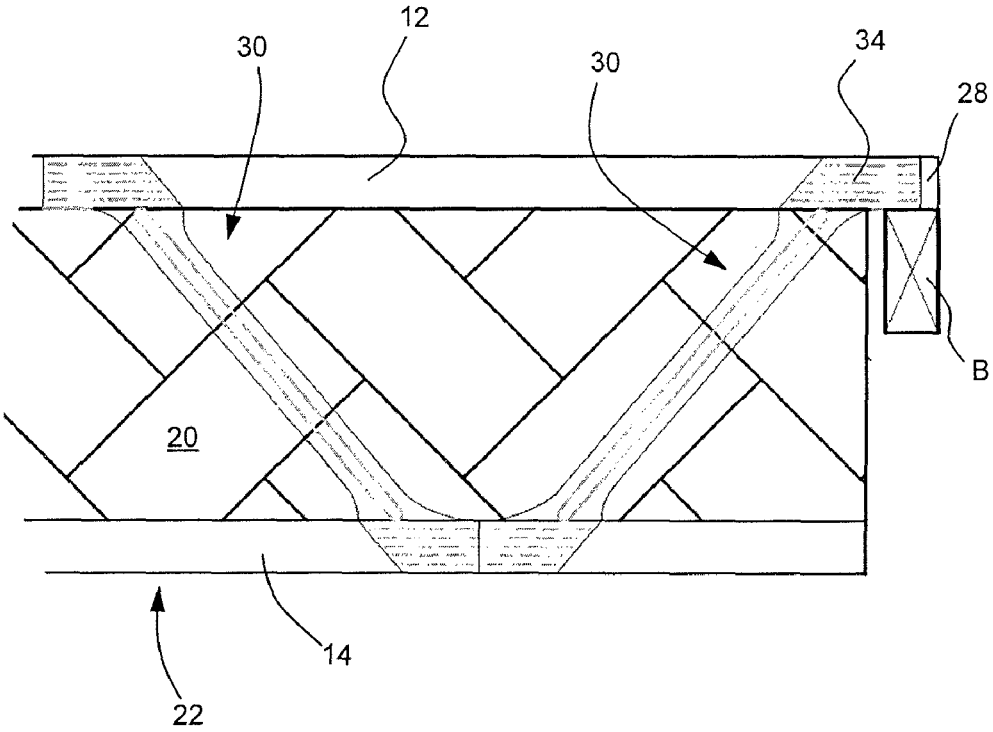
FIG. 7 is an enlarged elevation view of an end of the wooden joist of FIG. 1, with pairs of metal webs forming a V.
Figure 8:
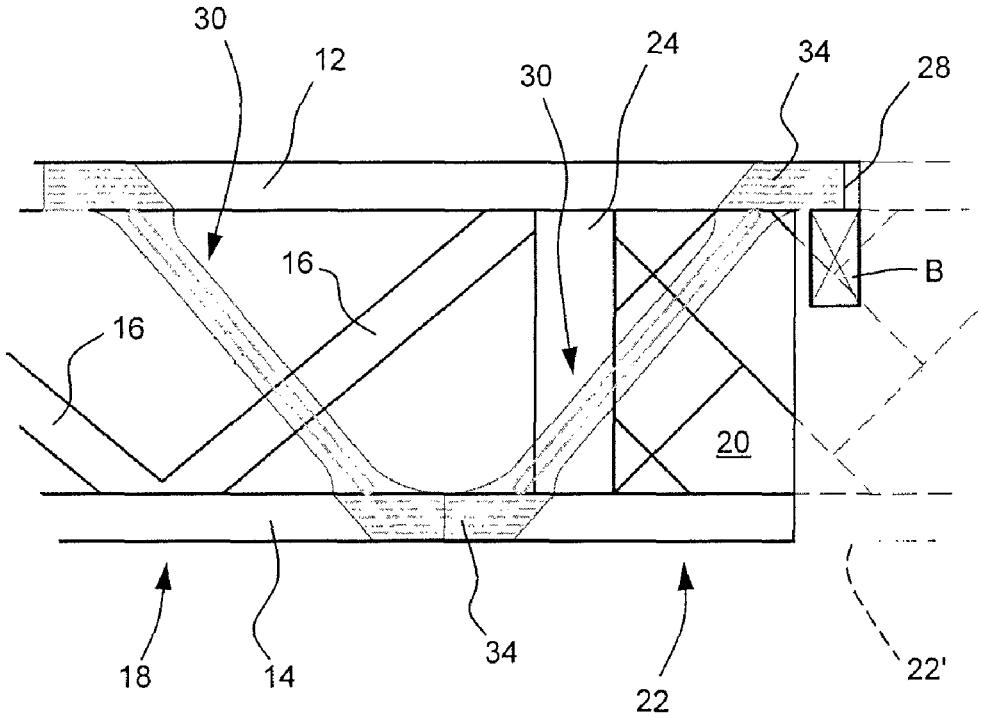
FIG. 8 is an enlarged elevation view of an end of the wooden joist of FIG. 1, with pairs of metal webs forming a V and with a removed I-joist section.

Referring to FIG. 7, a second pair of metal webs 30 (one of which is shown, as the other is on the hidden side) may be pressed onto the wooden joist 10 to form a pair of Vs, so as to increase the support between the top chord 12 and the bottom chord 14. This configuration may be selected for longer wooden joists 10, or in view of particular uses in which the wooden joist 10 is subjected to higher loads while in top-chord bearing support on the beam B. As shown in FIG. 7, the Vs of metal webs 30 may be in the I-joist section 22 of the wooden joist 10. Alternatively, as shown in FIG. 8, the Vs of metal webs 30 may overlap between the open-joist section 18 and the I-joist section 22.

Figure 9:
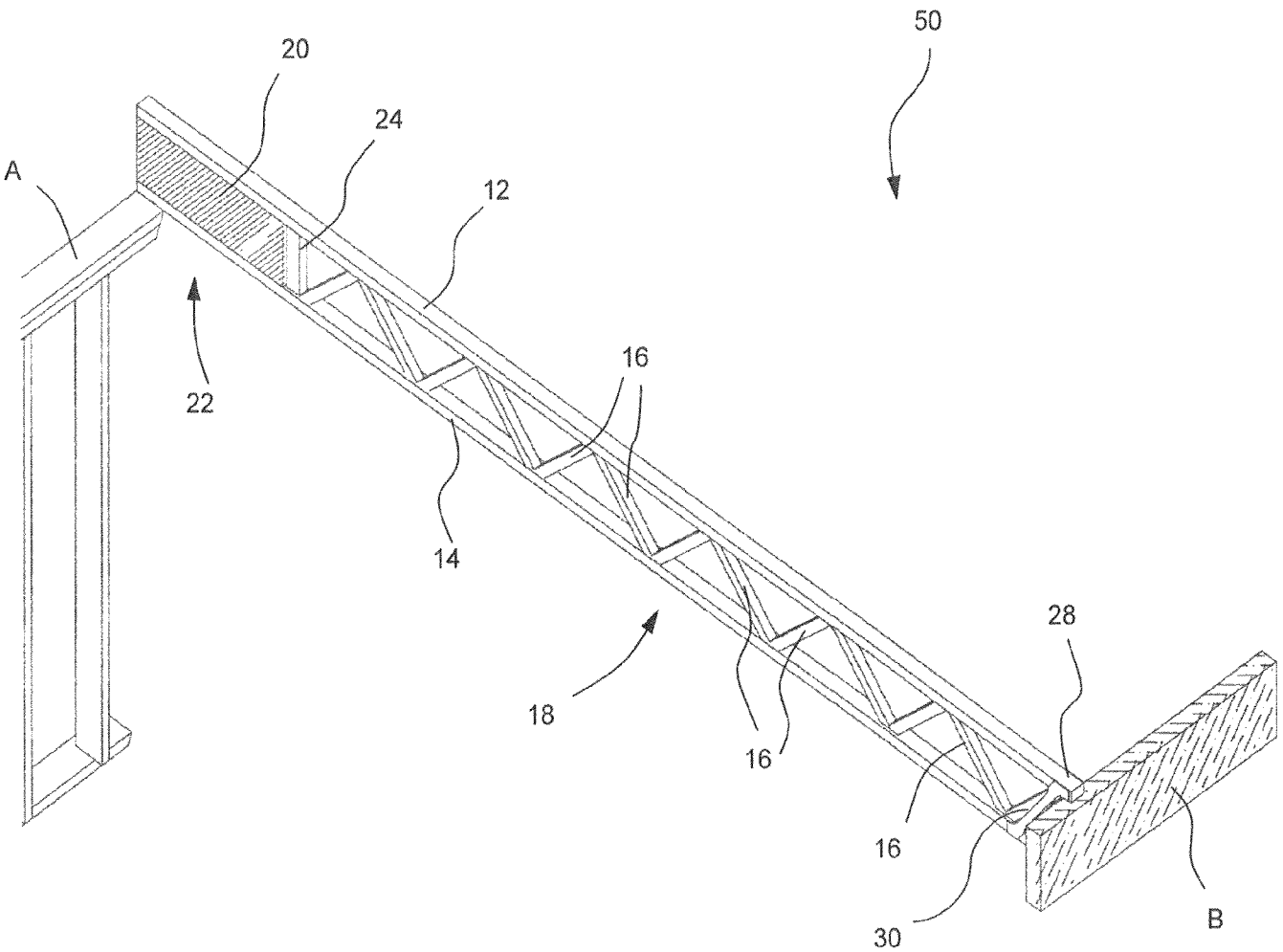
FIG. 9 is a perspective view of a wooden joist in accordance with another embodiment, in a top-chord bearing relation with a beam, on an open-joist section.
Figure 11:
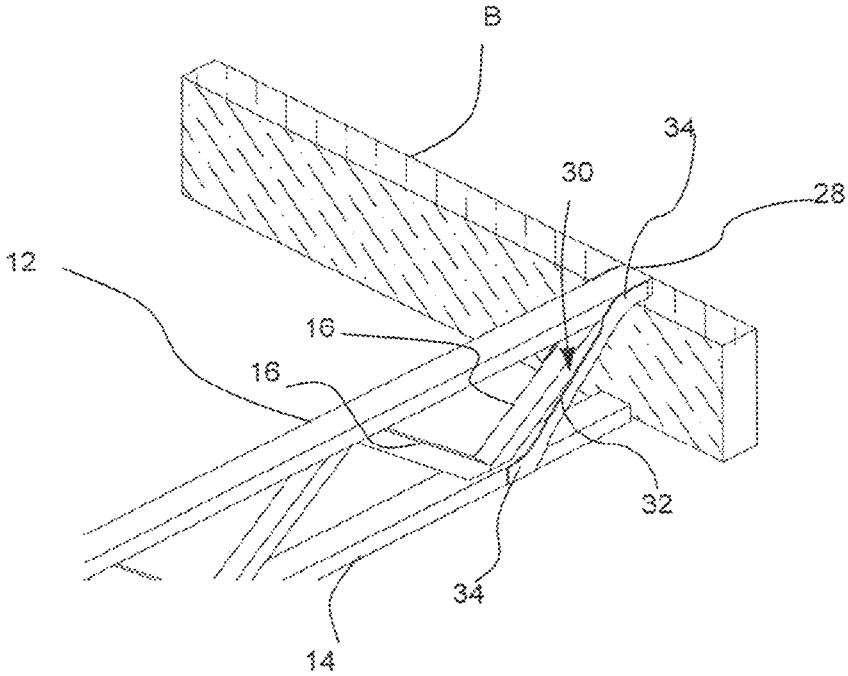
FIG. 11 is an enlarged perspective view of the wooden joist of FIG. 9, with an end in a top-chord bearing relation with a beam.
Figure 12:
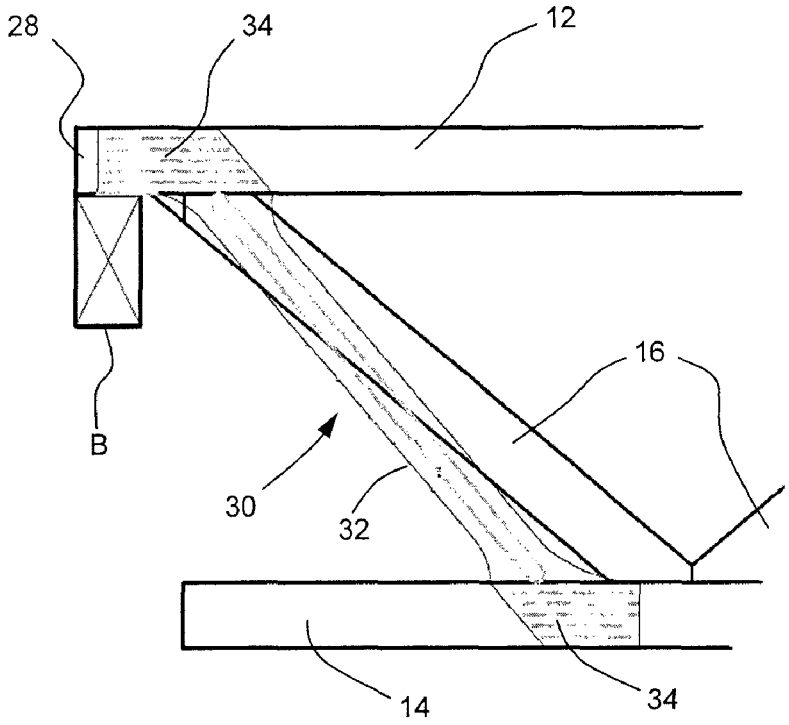
FIG. 12 is an enlarged elevation view of the end of the wooden joist of FIG. 10.

Referring to FIG. 9, a wooden joist in accordance with another embodiment of the present disclosure is generally shown at 50. The wooden joist 50 is similar in construction to the wooden joist 10 of FIGS. 1 to 8, whereby like components bear like reference numerals. However, despite the similarities, the wooden joist 50 of FIG. 9 is in top-chord bearing relation with the beam B from the end of the open-joist section 18. Referring to FIGS. 11 and 12, the bearing extension 28 extends beyond a top end of one of the wooden webs 18. The top connector ends 34 of the metal webs 30 are on the bearing extension 28, whereby the top connector ends 34 are on top of the beam B when the wooden joist 50 is in top-chord bearing relation with the beam B.

Figure 10:
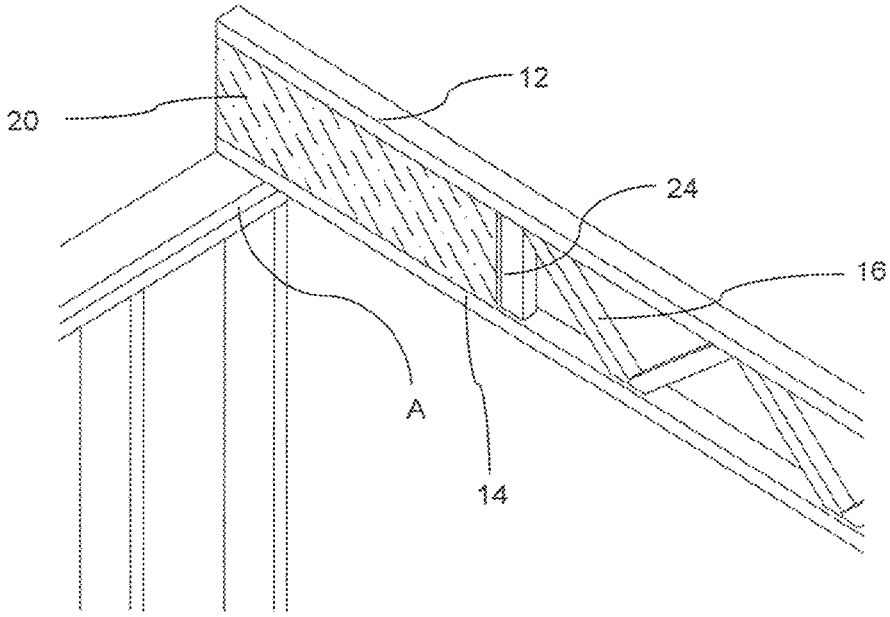
FIG. 10 is an enlarged perspective view of the wooden joist of FIG. 9, with an end in a bottom-chord bearing configuration.

Referring to FIG. 10, the I-joist section 22 is in a bottom-chord bearing relation with the structure A. The length of the I-joist section 22 may be reduced so as to obtain a wooden joist of selected length. The wooden joist 50 may be sectioned on site.

Figure 13:
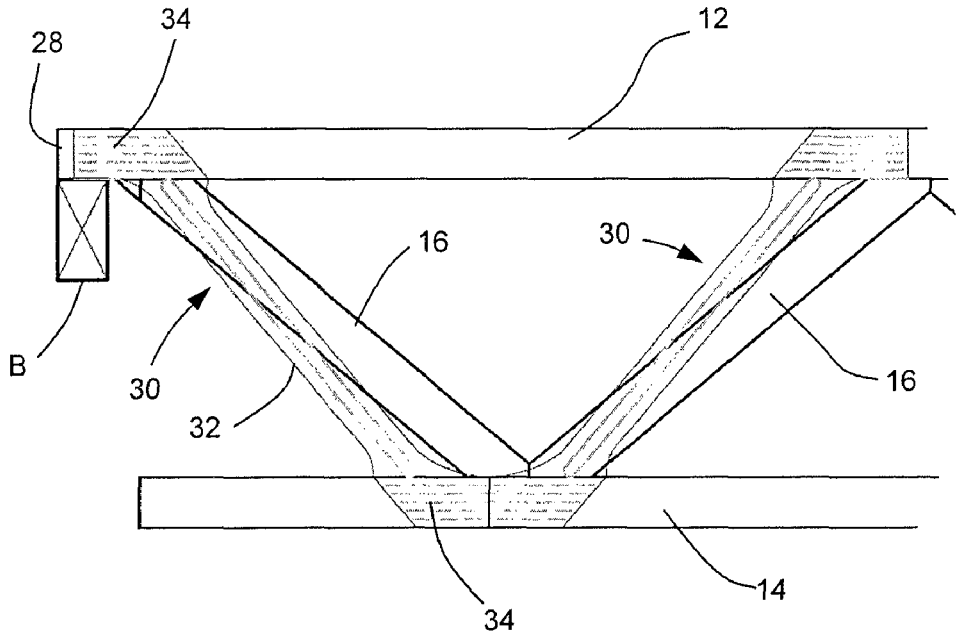
FIG. 13 is an enlarged view of the end of the wooden joist of FIG. 11, with pairs of metal webs forming a V.
Figure 14:
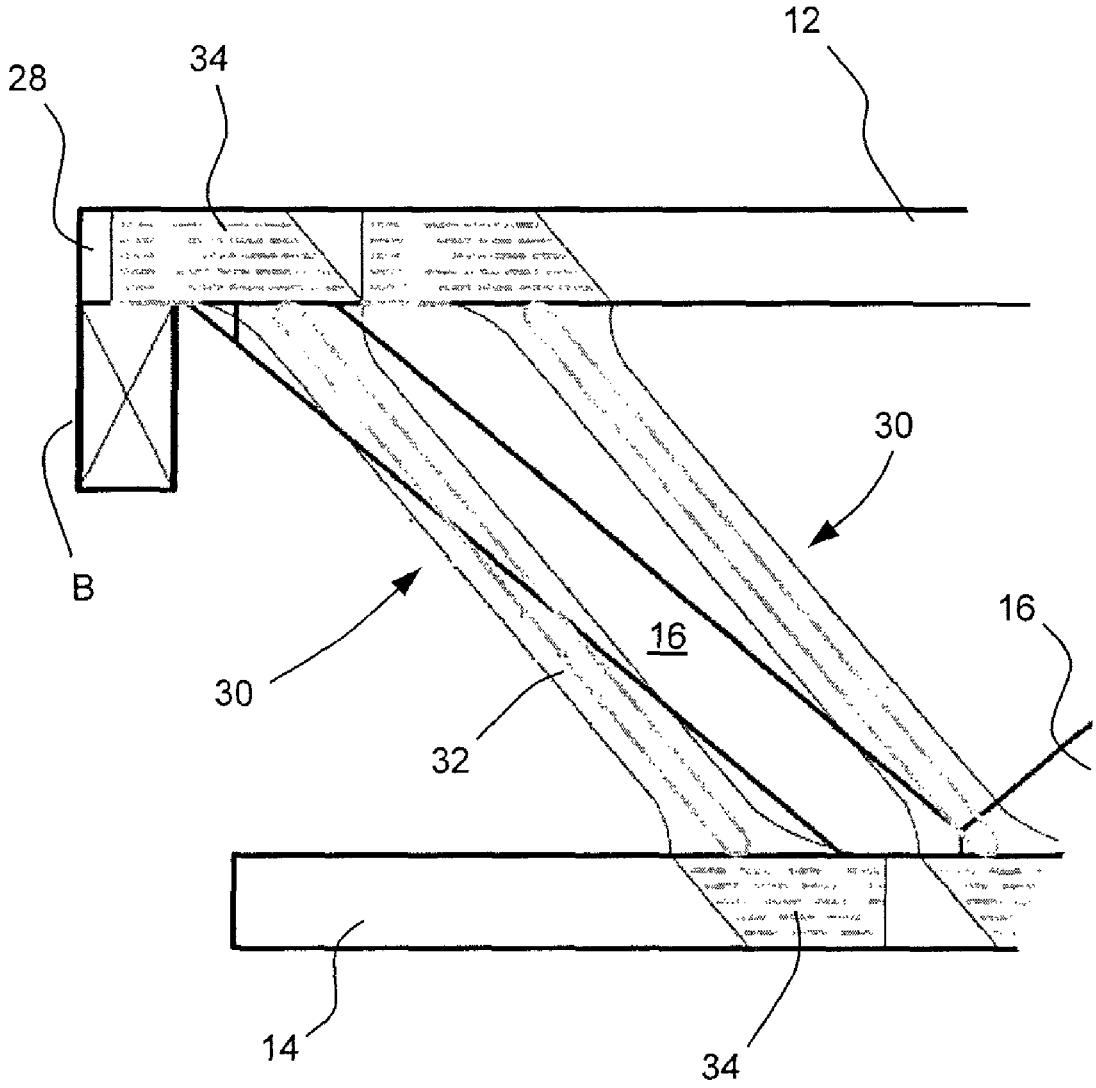
FIG. 14 is an enlarged view of the end of the wooden joist of FIG. 11, with pairs of metal webs in a parallel relation.

Referring to FIGS. 13 and 14, additional metal webs 30 may be used to reinforce the structural connection between the top chord 12 and the bottom chord 14. In FIG. 13, two pairs of metal webs 30 (on opposed sides of the wooden joist 50) are arranged to form a V-shaped structure. In FIG. 14, two pairs of metal webs 30 (on opposed sides of the wooden joist 50) are arranged to have the metal webs 30 of the same side in a parallel relation. Both these configurations increase the contact area between connector ends 34 of the metal webs 30 and the chords 12 and 14, thereby structurally reinforcing the wooden joist 50.

Figure 15:
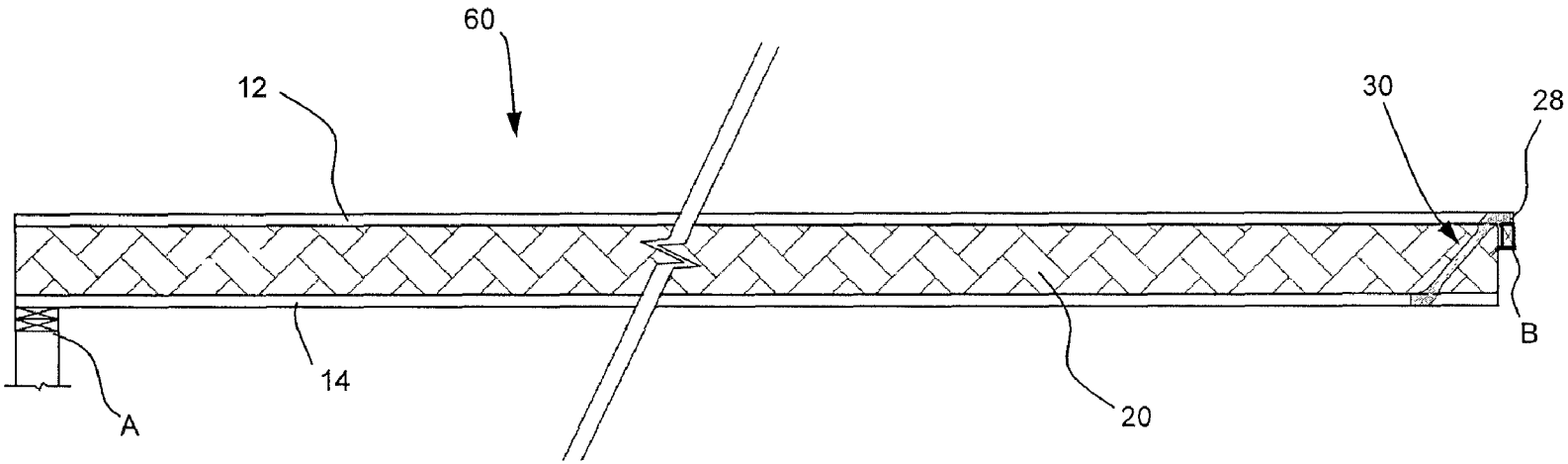
FIG. 15 is a perspective view of a wooden I-joist in accordance with yet another embodiment, in a top-chord bearing relation with a beam.

Referring to FIG. 15, a wooden joist in accordance with yet another embodiment is generally shown at 60. The wooden joist 60 is similar in construction to the wooden joist 10 of FIGS. 1 to 8, whereby like components bear like reference numerals.

The wooden joist 60 does not have an open-joist section. Accordingly, the joist 60 has wooden boards 20 on its full length. The wooden joist 60 has a bearing extension 28 at one of its ends, whereby the wooden joist 60 may be installed in a top-chord bearing relation with a beam B. In order to adjust its length, the opposite end of the wooden joist 60 may be sectioned. The sectioning may be performed on site or off site.

By having the use of metal webs 30 limited to the end of the wooden joists 10, 50 and 60, these wooden joists have a limited amount of metal components, thereby reducing their cost. The metal webs 30 structurally reinforce the joist 10, 50 and 60, by providing an additional amount of retention between the chords 12 and 14 (i.e., tensile strength). This additional amount of retention adds to that provided by the adhesive connection between the chords 12 and 14. Accordingly, by the presence of the metal webs 30, the stiffness and damping of the wooden joists 10, 50 and 60 are increased. It is pointed out that metal webs 30 can be provided at both ends of the wooden joists 10, 50 and 60, so as to have the wooden joists 10, 50 and/or 60 supported in top-chord bearing on both ends.

As a non-limitative example, the wooden joists 10, 50 and 60 typically have a span of 8 to 30 feet. The metal web 30 covers approximately 1 foot of span, and a pair of webs 30 combined in a V-shape (e.g. FIG. 7) spans on 2 feet. The metal webs 30 are in the end region of the joists so as to cover between 5 to 15% of the end of the joist in terms of span. Configurations in which more than a pair of metal webs 30 are used are typically for longer spans of wooden joist.

The invention claimed is:

1. A wooden joist comprising:

a wooden top chord;

a wooden bottom chord;

wooden boards adhesively connected to the wooden top chord and to the wooden bottom chord to form an I-joist section along a portion of the wooden joist;

wooden webs adhesively connected to the wooden top chord and to the wooden bottom chord to form an open-joist section along another portion of the wooden joist;

a bearing extension defined by the wooden top chord extending beyond any one of the wooden boards and the wooden webs at an end of the wooden joist;

at least a pair of metal webs in alignment on opposed sides of the wooden joist, each metal web comprising a top connector end fixed to the bearing extension, a bottom connector end fixed to the bottom chord, and a structural arm between the connector ends, the metal webs being solely provided in an end region along the wooden joist;

whereby the wooden joist is adapted to be in a top-chord bearing relation with a beam by the bearing extension and the top connector ends being on top of the beam.

2. The wooden joist according to claim 1, wherein the metal webs are at least partly in the I-joist section of the wooden joist.

3. The wooden joist according to claim 2, wherein a portion of the I-joist section is removed prior to the pair of metal webs being installed, such that the wooden joist has a selected length.

4. The wooden joist according to claim 3, wherein the structural arm of the metal webs overlaps a junction between the I-joist section and the open-joist section.

5. The wooden joist according to claim 1, further comprising two pairs of the metal webs at the end region of the wooden joist.

6. The wooden joist according to claim 5, wherein the two pairs of the metal webs are arranged to form V-shaped structures of webs on the opposed sides of the wooden joist.

7. The wooden joist according to claim 5, wherein the two pairs of the metal webs are arranged such that the structural arms of the metal webs are parallel to one another on the opposed sides of the wooden joist.

8. The wooden joist according to claim 1, wherein the metal webs are in the open-joist section of the wooden joist.

9. The wooden joist according to claim 8, wherein a portion of the I-joist section is removed, such that the wooden joist has a selected length.

10. The wooden joist according to claim 1, further comprising a wooden column between the open-joist section and the I-joist section.

11. The wooden joist according to claim 1, further comprising said metal webs in the two end regions of the wooden joist.

12. A method for adapting a wooden joist to a top-chord bearing configuration, comprising:

providing a joist having a wooden top chord and a wooden bottom chord adhesively connected to wooden boards to form a joist having at least an I-joist portion;

cutting an end of the I-joist section as a function of a required length of the wooden joist in such a way that a bearing extension is defined by the top chord extending beyond the wooden boards at an end of the I-joist;

securing metal webs on opposed sides of the wooden joist solely in the end region of the wooden joist such that the metal webs are connected to the bearing extension and the wooden bottom chord;

whereby the joist may be used in a top-chord bearing relation with a beam.

13. The method according to claim 12, further comprising securing additional metal webs on opposed sides of the wooden joist such that any one of a V-shaped structure of webs and a parallel arm structure is formed.

14. A wooden joist comprising:

a wooden bottom chord;

wooden boards adhesively connected to the wooden bottom chord so as to project upwardly therefrom;

a wooden top chord adhesively connected to a top edge of the wooden boards to form an I-joist section with the wooden bottom chord and the wooden boards, the wooden top chord extending beyond the wooden boards at an end of the wooden joist to form a bearing extension; and at least a pair of metal webs in alignment on opposed sides of the I-joist, each metal web comprising a top connector end fixed to the bearing extension, a bottom connector end fixed to the bottom chord, and a structural arm between the connector ends, the metal webs being solely provided in an end region along the I-joist;

whereby the wooden joist is adapted to be in a top-chord bearing relation with a beam by the bearing extension and the connector ends being on top of the beam.

15. The wooden joist according to claim 14, further comprising two pairs of the metal webs at the end region of the wooden joist.

16. The wooden joist according to claim 15, wherein the two pairs of the metal webs are arranged to form V-shaped structures of webs on the opposed sides of the wooden joist.

17. The wooden joist according to claim 15, wherein the two pairs of the metal webs are arranged such that the structural arms of the metal webs are parallel to one another on the opposed sides of the wooden joist.

18. The wooden joist according to claim 14, wherein a portion of the I-joist section is removed, such that the wooden joist has a selected length.

19. The wooden joist according to claim 14, further comprising said metal webs in the two end regions of the wooden joist.

* * * * *